United States Patent [19]

Phillips

[11] 4,072,032

[45] Feb. 7, 1978

[54] KEY CHANGEABLE LOCK

[75] Inventor: Peter J. Phillips, Redondo Beach, Calif.

[73] Assignees: Klaus Gartner, La Palma; Tim Uyeda, South San Gabriel, both of Calif.

[21] Appl. No.: 691,454

[22] Filed: June 1, 1976

[51] Int. Cl.[2] ..... E05B 35/12

[52] U.S. Cl. ..... 70/339; 70/355; 70/383

[58] Field of Search ..... 70/339, 355, 382, 383, 70/384, 385, 337

[56] References Cited

U.S. PATENT DOCUMENTS

| | | | |
|---|---|---|---|
| 1,268,900 | 6/1918 | Watson | 70/383 |
| 1,447,865 | 3/1923 | Kihm | 70/385 |
| 1,546,001 | 7/1925 | Benhem | 70/339 |
| 3,978,700 | 9/1976 | Glass | 70/339 |

*Primary Examiner*—Robert L. Wolfe
*Attorney, Agent, or Firm*—Poms, Smith, Lande & Glenny

[57] ABSTRACT

A double key changeable safety deposit lock includes a movable bolt and associated bolt plate including cam surfaces to be engaged and moved between open and closed positions by turning renter and guard keys in the lock, a plurality of gated tumbler renter key levers to be engaged by the renter key, a plurality of gated tumbler guard key levers to be engaged by the guard key, each of the levers being moved to align their respective gates to receive latch members on the bolt plate upon manipulation of the two keys to allow opening of the lock and wherein pivot means are provided for each lever including a plurality of individually selectable pivots such that the pivotal axis of each lever may be selectively varied to provide for different combinations of lever movement required by an associated key to align the associated gates. Releasable pivot selecting means are provided for normally engaging certain ones of the pivots of the levers which is rotatable to allow release of the lever pivots so that the levers may be moved to a new combination of positions by the insertion and manipulation of new renter and/or guard keys and then held in the new combination by re-engaging the pivot selecting means, also referred to as a fulcrum means, with the selected ones of the pivots whereby both keys for the double key lock are changeable.

20 Claims, 19 Drawing Figures

Fig. 2.
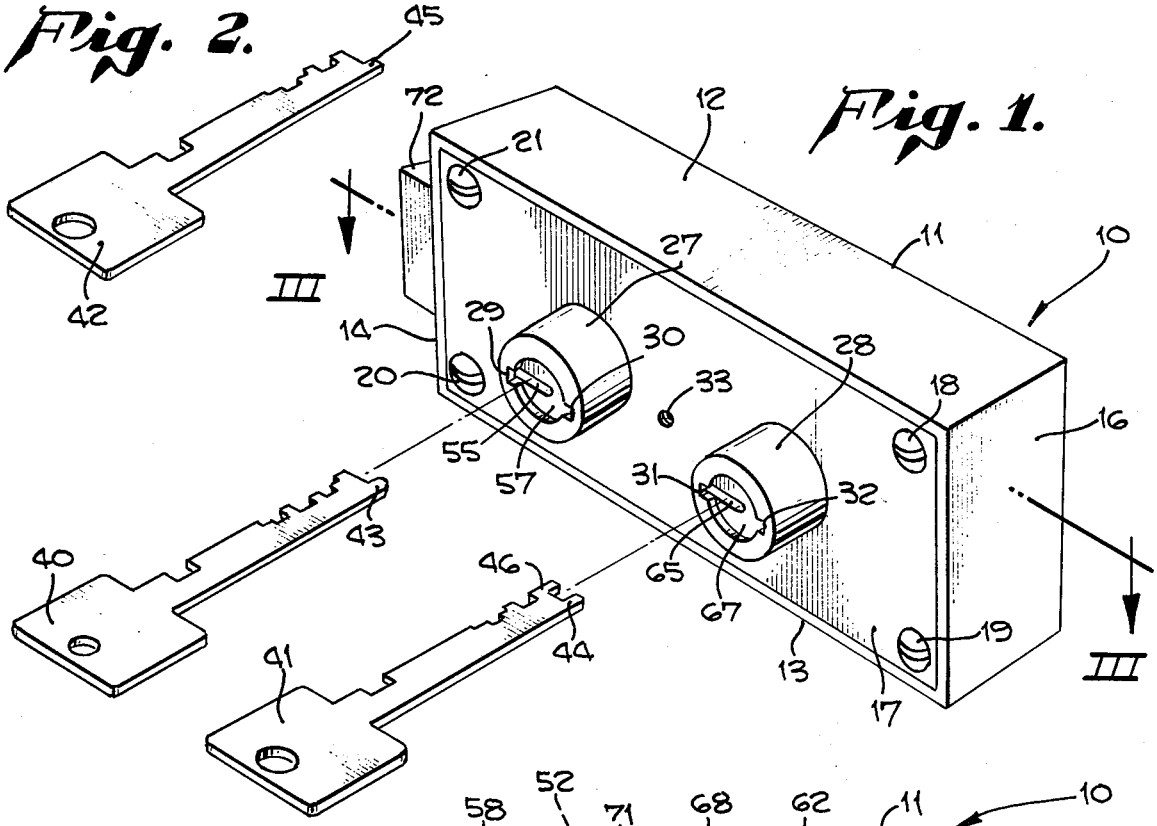
Fig. 1.
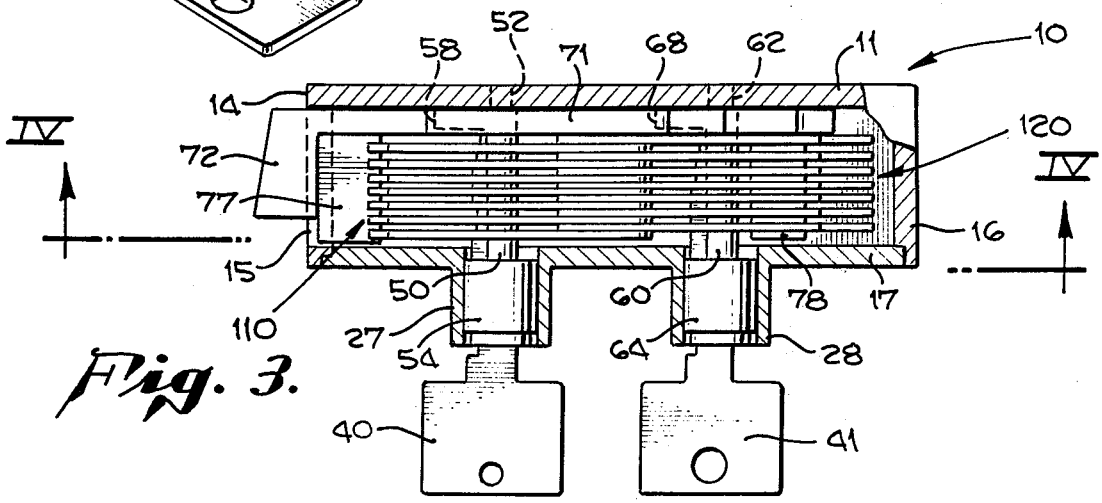
Fig. 3.
Fig. 4.
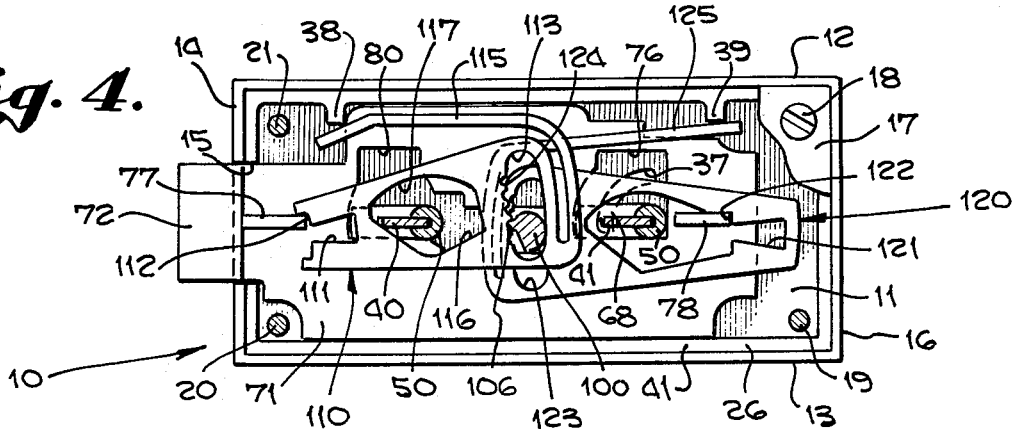

Fig. 5.
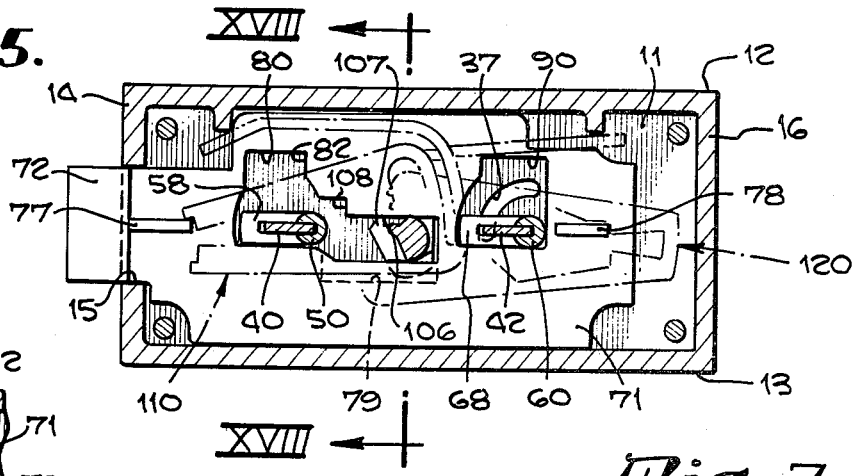
Fig. 6.
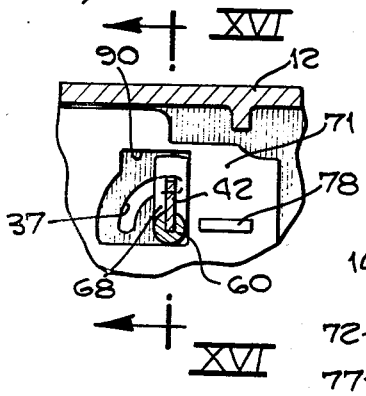
Fig. 7.
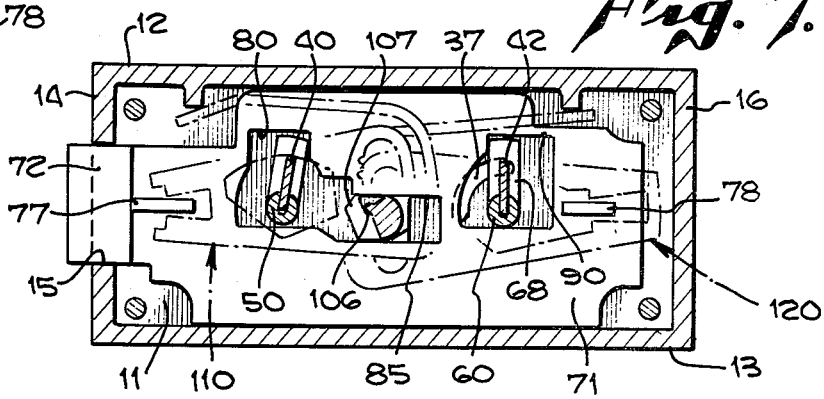
Fig. 8.
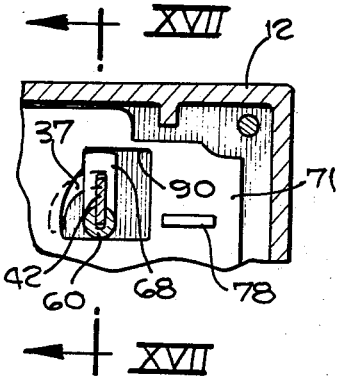
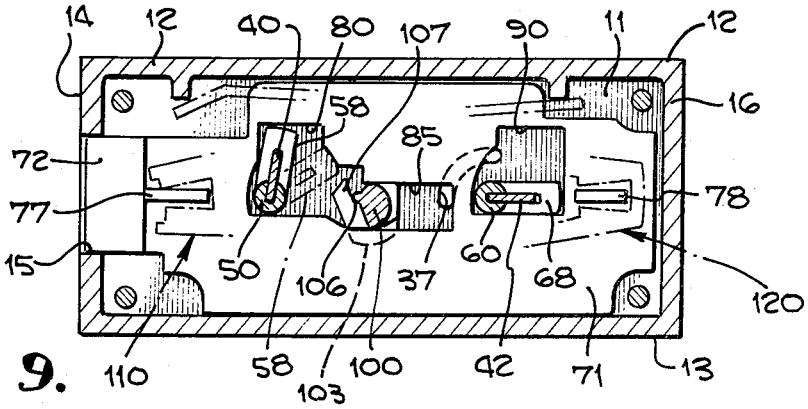
Fig. 9.
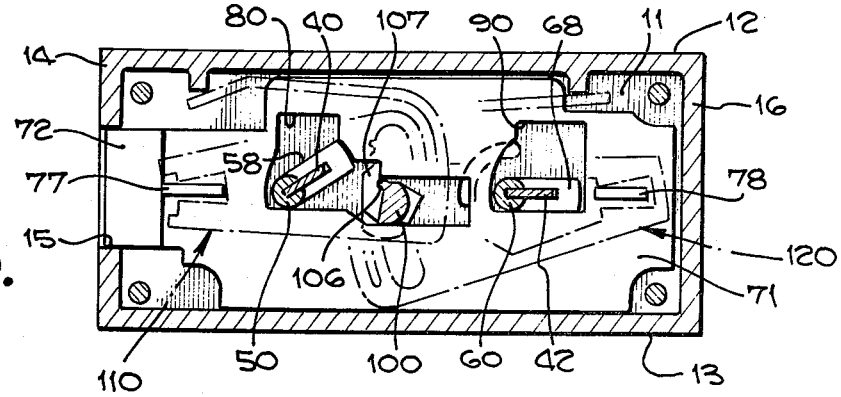
Fig. 10.

KEY CHANGEABLE LOCK

BACKGROUND OF THE INVENTION

The present invention relates in general to changeable key locks and more specifically to locks having one or more keys for operating the lock between open and closed positions and wherein the internal mechanism of the lock may be selectively manipulated to accommodate the use of different keys.

Various types of key changeable locks have been developed heretofore wherein a single key is employed for turning associated internal tumbler levers of the lock between open and closed positions. An example thereof is the prior U.S. Pat. No. 1,693,731 wherein a plurality of plate like latch members are releasably secured to the bolt. A plurality of gated tumbler levers are provided on fixed pivots and are moved by the key tumblers to align the gates to the aforementioned latches. The key can be changed by releasing the latches from the bolt, placing a new key in the lock in engagement with the fixed pivot tumbler levers in latch released relation and then re-engaging the tumbler levers with the latches to fix the combination. In another prior art example, U.S. Pat. No. 1,268,900 a single changeable key lock is shown in association with a plurality of gated levers. The levers are stated as being gated at opposite ends and pivoting about a fixed axis within the lock to alternately engage primary and auxiliary, separately movable bolt and auxiliary bolt members.

The lock constructions of the prior art, including those of the references noted, do not facilitate the provision of a double changeable key lock as would be desirable for modern safety deposit locks wherein both the renter and guard keys are changeable and further are not believed to present a satisfactory construction or mode of operation for a single changeable key lock.

It is therefore the primary object of the present invention to disclose and provide a changeable key lock wherein the lock may be simply and economically constructed, assembled and manipulated in use, where the key can be easily changed and the lock is reliable and secure in its operation. It is also an object of the present invention to disclose and provide such a lock wherein two changeable keys are provided for operating the lock and the internal lock mechanism is simply and reliably manipulable for changing the combination required of both keys for opening of the lock.

Generally stated, the present invention in changeable key lock includes the provision of a plurality of gated tumbler levers and means for operating the bolt only when the tumbler levers are placed in predetermined positions of adjustment by manipulation of a selected key in the lock. Pivot means are provided on one or more of the levers for providing a plurality of individually selectable pivots about which the associated lever may pivot whereby the pivotal axis of each such lever may be varied to provide for different combinations of lever movements required to open the lock. Releasable fulcrum means are provided for engaging with the lever pivots to restrict each levers movement about a selectable one of the pivots when engaged therewith, the fulcrum means being movable when the lock is in unlocked condition to release the levers and provide for a new coding of the lever combinations prior to being re-engaged through the normal locking manipulation of the replacement keys.

More specifically, the present invention contemplates a double key changeable safety deposit lock including a movable bolt operated in assocition with a first set of renter key tumbler levers to be engaged by a renter key and a second set of guard key tumbler levers to be engaged by a guard key. Each of the foregoing levers include pivot means as aforestated for providing a plurality of individually selectable pivots whereby the pivotal axis of each lever may be varied to provide for different combinations of lever movement required by the two associated keys to align the associated gates. Releasable fulcrum means, or pivot selecting means, are also provided for normally engaging certain ones of the pivots of the two sets of levers for maintaining them in a predetermined fixed axis of pivotal movement during opening and closing operations, but allowing for a release of their pivotal axis when desired to reset the combination of levers to accommodate replacement or changed guard and/or renter keys.

A more complete understanding of the present invention, as well as a better understanding of how the present invention in key changeable lock improves upon the state of the art and achieves the objectives aforestated therefor will be provided to those skilled in the art from a consideration of the following detailed description of a preferred exemplary embodiment thereof. Reference will be made to the appended sheets of drawings which will be briefly described prior to the detailed explanation.

BRIEF DESCRIPTION OF THE DRAWINGS

FIG. 1 is a perspective view of a preferred exemplary embodiment of changeable key lock according to the present invention showing selected guard and customer keys;

FIG. 2 is a perspective view of a change key employed with the preferred exemplary embodiment of lock of FIG. 1;

FIG. 3 is a section view of the lock of FIG. 1 taken therein along the plane III—III;

FIG. 4 is a front elevational view, with portions of the front face of the lock removed, taken in FIG. 3 along the vertical plane IV—IV;

FIG. 5 is a view of the lock of FIG. 4 with the exemplary tumbler levers shown in phantom and the lock in bolt closed position;

FIG. 6 is a detail view of the lock of FIG. 5 showing the guard key turned to open position;

FIG. 7 is a view of the lock of FIG. 5 showing the customer and guard keys moved to open positions and the bolt withdrawn to a lock opened position;

FIG. 8 is a detail view of the lock of the FIG. 7 showing the guard key removed and a change key inserted;

FIG. 9 is a view of the lock as in FIG. 7 showing the change key turned fully clockwise and the bolt fully withdrawn to a change key position;

FIG. 10 is a view of the lock as in FIG. 9 showing the fulcrum means rotated to a lever release position wherein the pivot means of the levers are released from the fulcrum member;

DETAILED DESCRIPTION OF THE PREFERRED EXEMPLARY EMBODIMENT

Figure 11:
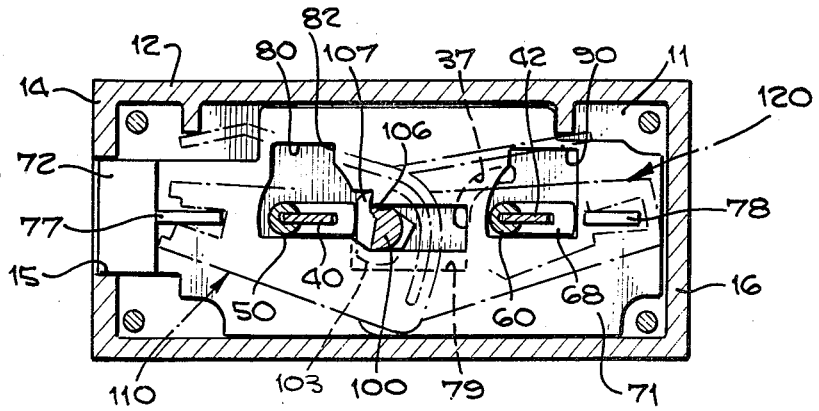
FIG. 11 is a view of the lock as in FIG. 10 showing the customer key turned fully lockwise to be withdrawn and replaced by a different customer key.

Referring initially to FIGS. 1, 3, 4 and 19 a detailed description of the preferred exemplary embodiment in key changeable lock, in accordance with the present invention, will now be made. The preferred exemplary embodiment comprises a double key changeable safety deposit lock, indicated generally at 10, which may, in accordance with certain aspects of the present invention, be provided as a single changeable key lock as well.

The exemplary double key changeable safety deposit lock, indicated generally at 10, includes a housing or casing having a back wall 11, top wall 12, bottom wall 13 (FIG. 4) a latch receiving end 14 having the port 15 and a closed end 16. A conventional face plate 17 is shown secured by fasteners, preferably machine bolts, 18–21 which pass through appropriate bolt holes 22–25 in face plate 17 to engage threaded ports in the casing backwall, as threaded hole 24', (FIG. 19) to retain the face plate within recess 26 formed about the opening of the casing or housing. As is also conventional, face plate 17 is provided with key bosses 27 and 28, each having opposed key guide notches 29,30 and 31,32 respectively.

Referring again to FIG. 1, the exemplary lock, indicated generally at 10, is shown as a double key lock adapted to receive a customers or renters key 40 and a guard key 41. As is particularly contemplated within the present invention, the present lock is adapted to be changed to accommodate a change in both the renters and guard keys. A change key 42, as seen in FIG. 2, is employed in the key changing process as will be described hereinafter. At present, it should be noted that each of the keys has a first upper end projection 43,44 and 45, respectively with the guard key 41 having an additional stop or cam follower projection 46.

Figure 19:
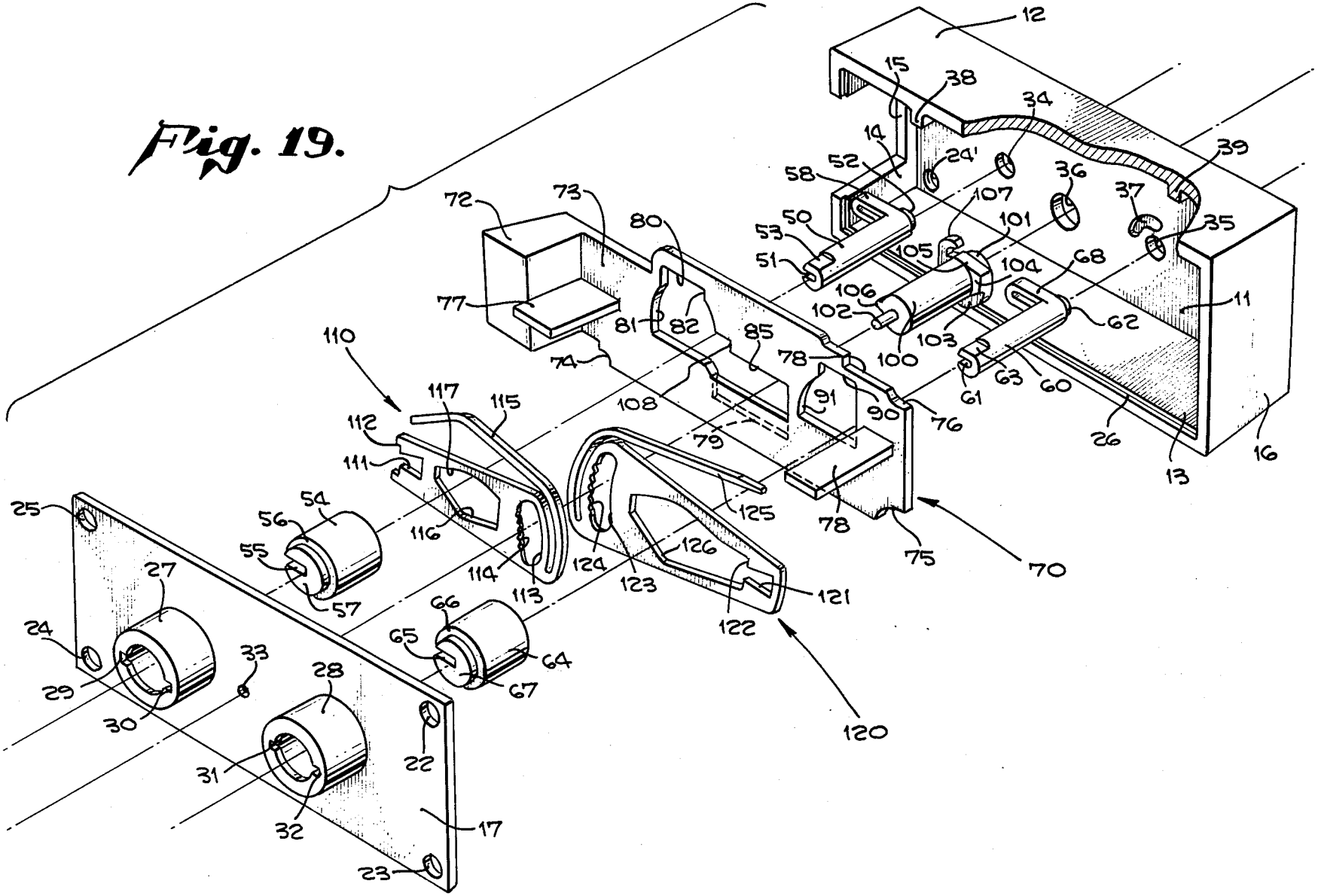
FIG. 19 is an exploded perspective view, partially in section, of the lock of FIGS. 1 through 18.

The renter key 40 is adapted to be received in an otherwise conventionally journaled key guide post provided within the face plate boss 27. As best seen in FIGS. 3 and 19, a key guide post 50 is provided for receiving the renter key 40 in the key slot 51. The renter key guide post 50 has a base bearing portion 52 adapted to fit in journal aperture 34 at its lower end. Post 50 is received within a key guide journal bearing 54 which has an internal bore terminating in an internal non-circular portion adapted to mate with the flat 53 of post 50 to non-rotatably join the post 50 to the journal 54. Journal 54 is provided with a key slot 55 which is aligned to post key slot 51 through the provision of mating flat 53 fitting appropriately within journal 54. The journal bearing 54, as is conventional, is provided with a recess 56 surrounding an end face 57 adapted to fit into the opening of boss 27. A guide post cam 58 is provided adjacent the lower end of post 50 to engage and act upon portions of the bolt as hereinafter explained.

The guard key 41 is adapted to fit into similarily provided guard key guide post 60, having key slot 61, base bearing 62 and flat 63 as in the case of post 50. Post 60 mates with its associated guard key guide journal bearing 64 having key slot 65, recess 66 and end faced 67 mating with boss 28 in the same manner as described with regard to journal bearing 54 and boss 27. Guard post 60 is also provided with a guard post cam 68 adjacent its lower end for acting upon portions of the bolt as hereinafter explained.

Bolt means are provided in the exemplary embodiment of lock including a bolt plate indicated generally at 70 and as best seen in FIG. 19. The exemplary bolt plate, indicated generally at 70, includes a body portion 71 mounting an integrally formed bolt or latch 72 extending from a shank portion 73. Body portion 71 has peripheral cutouts 74, 75 and 76 to provide clearance for the bolts aforementioned. Latch plates 77 and 78, extending laterally of body 71 as best seen in FIG. 19, are provided for controlling opening movement of the bolt plate in co-operation with the tumbler levers to be described hereinafter.

The bolt plate is apertured to provide surfaces cooperating with the guide post cams 58 and 68. A renters key cam aperture 80 is provided in base plate body 71 as best seen in FIG. 19 with a closing cam surface 81 and an opening cam surface 82. As will be apparent to those skilled in the art, rotation of renter key guide post 50 will cause the associated cam 58 to alternately engage cam surfaces 81 and 82 depending upon the direction of rotation of the post. A central rectangular slot 85 is provided to accommodate portions of the fulcrum member 100, to be described hereinafter. As can also be seen in FIG. 19, a guard key cam aperture 90 is provided in body 71 with a closing cam surface 91 and an opening cam surface 92 to co-operate, as subsequently described, with guard key post 60 and the latters cam 68.

Figure 18:
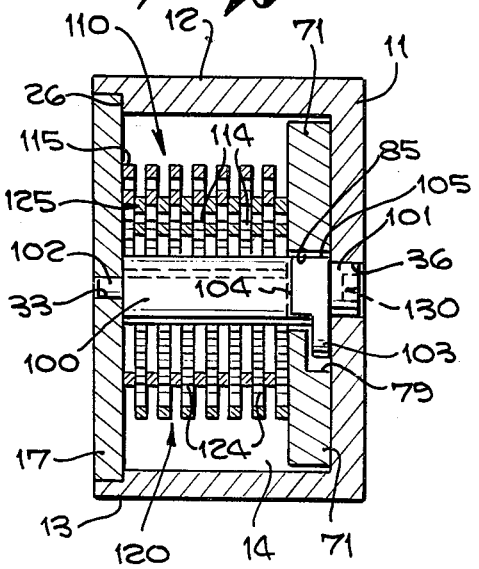
FIG. 18 is a section view of the lock taken in FIG. 5 along the plane XVIII—XVIII.

A plurality of gated tumbler levers, indicated generally at 110 and 120, are provided in accordance with the present invention to be selectively and pivotally located with respect to fulcrum means for restricting the axis of pivotal movement of each lever once a particular pivotal axis therefor has been selected. The fulcrum means therefor, as particularly contemplated with the present invention, comprises a fulcrum member 100 as best seen in FIGS. 18 and 19. Fulcrum member 100 has a base bearing 101 adapted to fit within journal aperture 36. A top pin or stub shaft 102 is provided on fulcrum member 100 to be received in the mating journal aperture 33 in face plate 17. As can be seen in FIG. 18, the fulcrum member 100 is rotatably mounted by its pivotal mounting in the opposed face plate and rear wall of the lock housing or casing. Fulcrum member 100 is further provided with a laterally extending cam 103 which rides in a cam slot 79 formed in the body 71 of the bolt plate adjacent the rectangular aperture 85. A second cam portion 104 of the fulcrum member is adapted to ride in the rectangular slot 85 as seen in FIGS. 9, 10 and 18 and has a flat side thereof 105 abutting against an upper surface of slot 85 when in the lever engaging position of FIGS. 9 and 18, discussed more fully hereinafter. In such later discussion, reference will also be made to the lever pivot engaging rib 106 provided along the longitudinal extent of fulcrum member 100 and the return cam 107.

As seen in FIG. 3, and as represented schematically in FIG. 19, the lock of the present invention is provided with a plurality of gated tumbler levers indicated generally at 110 and 120. In the exemplary embodiment, there are 7 renter key gated tumbler levers, indicated generally at 110, and 7 guard key levers, indicated generally at 120. Considering first and individual renter key lever, all such levers being identical, and as best seen in FIG. 19, the renter key lever includes an open gate 111 at its forward end having a latch stop 112 adjacent the gate to abut against the latch plate 77 of the bolt plate when the bolt is in a closed condition as seen in FIG. 4. The guard key levers, indicated generally at 120, are also identical to one another, and as best seen in FIG. 19, each include an inwardly opening gate 121 at the free end having an inwardly facing latch stop 122 adapted to engage the latch plate 78 of bolt plate 70 as seen in FIG. 4 when the bolt is in closed position.

Each of the exemplary embodiment of gated tumbler levers, as is particularly contemplated within the present invention, is provided with pivot means for providing a plurality of individually selectable pivots about which the associated lever may pivot such that the pivotal axis for each such lever may be varied to provide for different combinations of lever movements required to open the lock. As seen in FIGS. 4 and 19, each of the renter key levers indicated generally at 110, include an arcuate port 113 having a plurality or rack of saw tooth-like teeth 114 formed on an inner surface thereof. The radius of curvature of arcuate slot 113 preferably intersects the associated gate 111 in a central portion to facilitate pivotal movement of the lever about its gated end during selection of one of the pivots provided by the teeth 114.

The pivot means on the guard key tumbler levers, indicated generally at 120, as seen in FIGS. 4 and 19, comprise the provision of an arcuate pivot port 123 on each lever with a plurality or rack of saw tooth-like teeth 124 formed on an inner surface of the arcuate slot. The radius of curvature for slot 124 preferably passes to the approximate center of gate 121 as noted hereinbefore with regard to the renter or customer key tumbler levers indicated generally at 110. It should be noted that the pivot providing teeth 114 are provided on an inward side of slot 113 relative to the lever while the teeth 124 are provided on an outward side of slot 123 relative the center of the levers indicated generally at 120.

As is particularly contemplated within the present invention, the customer or renter tumbler levers are provided in a first set, as best seen at 110 in FIGS. 3 and 4, in a horizontal array with the associated arcuate slot 113 of each entrained upon fulcrum member 100 and the associated gate 111 directed toward the forward latch plate 77 of the bolt plate. Each such lever is provided with an integrally formed spring arm 115 biasing the gated end to place latch stop 112 against latch plate 77. Each of these levers of the first set, indicated generally at 110, further include a central tumbler port 116 providing a tumbler surface 117 to be engaged by the teeth of the renter key 40.

The second set of gated tumbler levers, indicated generally at 120, to act with the guard key 41, and as best seen in FIGS. 3 and 4, are placed in a horizontal array with the arcuate slot 123 of each entrained over the fulcrum member 100 and the associated gate 121 adjacent the rear latch plate 78, the associated latch stop 122 of each lever abutting a rearward corner of plate 78. Each of these levers, indicated generally at 120, are also provided with an integrally formed spring arm 125, tumbler port 126 and tumbler surface 127, the latter being engagable by teeth of the guard key when the latter is inserted in the lock.

Preferably, the individual levers of the first and second sets, indicated generally at 110 and 120 respectively, are alternated one on the other, as best seen in FIG. 3, although it is contemplated that they could be otherwise located within the lock. However so located, it is important to the present invention that the oppositely directed sets of tumbler levers be located within the lock so that their respective pivot means, provided by the teeth 114 and 124 in the exemplary embodiment, be generally aligned horizontally so that selected ones of the pivots can be engaged by the fulcrum member 100, and specifically rib 106 in the exemplary embodiment, to releasably pivot each of the levers about selectable pivotal axis of each lever. As will be discussed more fully hereinafter during explanation of the operation of the lock, rotation of the fulcrum member 100 at the appropriate time will release each of the tumbler levers which will then be moved under the bias of their associated spring arms in a downward direction in FIG. 4 preparatory to being reset in any desired combination therefor through the insertion and manipulation of new renter and/or guard keys as will now be described in a detailed description of the opertion of the lock.

OPERATION OF THE LOCK

The preferred exemplary embodiment of key changeable lock is shown in FIGS. 1 through 4 in a locked condition. During normal operation of the lock to open the associated safe, such as a safety deposit box door, the renter key 40 and guard key 41 are inserted in the respective key slots 55 and 65 of key posts 50 and 60. On insertion of the keys, they pass freely through the tumbler apertures 116 and 126 of the two sets of tumbler levers, indicated generally at 110 and 120, respectively, which are in locking relation to the bolt latch plates 77 and 78 as seen in FIG. 4. This condition for the lock is illustrated in FIG. 5 with the plurality of tumbler levers removed and only a representative pair thereof being shown in phantom line so that the co-operation between the key posts 50 and 60, fulcrum member 100 and the bolt plate, indicated generally at 70, can be more easily observed.

Figure 16:
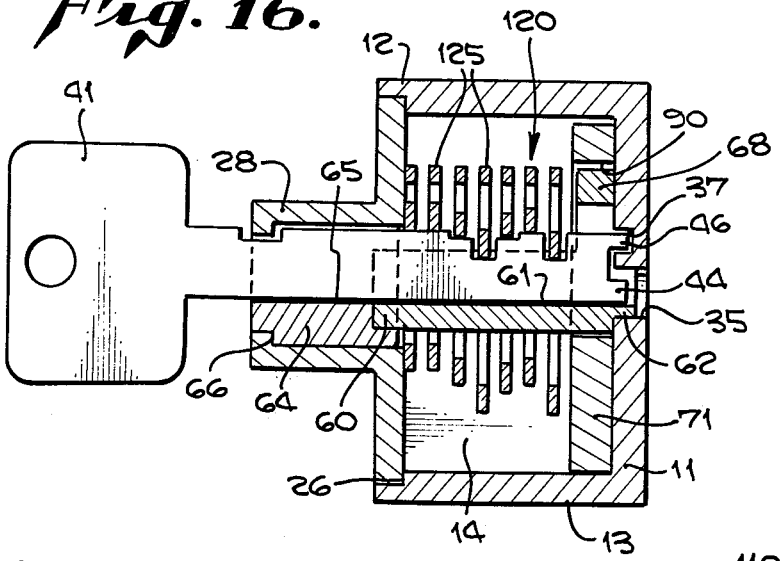
FIG. 16 is a section view of the lock taken in FIG. 6 along the plane XVI—XVI.
Figure 17:
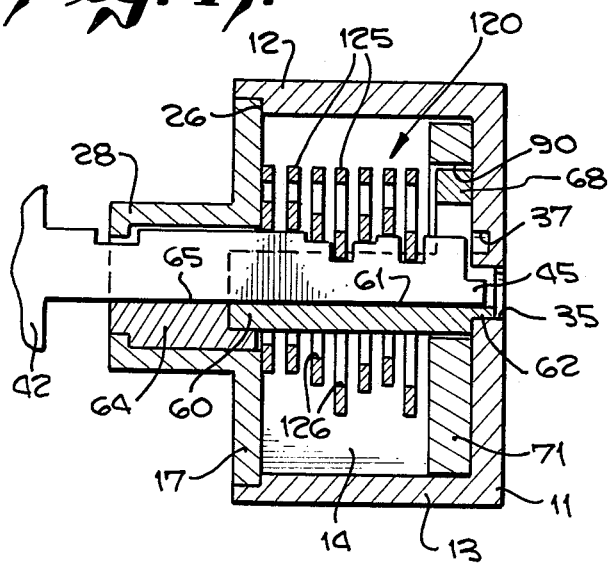
FIG. 17 is a detail section view of the lock taken in FIG. 8 along the plane XVII—XVII.

After the renter and guard keys 40 and 41 have been inserted into the lock, they may be turned clockwise to a lock open position as seen in FIG. 7. Guard key 41 must be first rotated from the position of FIG. 5 in a clockwise direction to that of FIG. 7 in order to move the guard post cam 68 away from cam surface 91 allowing for a withdrawal motion of the bolt plate from left to right in FIG. 5 to the position of FIG. 7. The bolt plate is moved to the position of FIG. 7, a lock open condition, by turning the renters key 40 clockwise in FIG. 5 against cam surface 82. Further inward or withdrawal motion of the bolt plate beyond the position illustrated in FIG. 7 is prevented due to the engagement of the bolt plate against the guard post cam 68, the guard post being held in the position of FIG. 7 due to the provision of the stop or cam follower projection 46 on the guard key which rides in arcuate cam slot 79 as seen in FIGS. 6 and 16. Withdrawal of either of the renter or guard keys is prevented when they are in the open position of FIG. 7 due to the presence of the end flanges of bosses 27 and 28.

The lock may be returned to a closed and locked condition by merely closing the safe door and turning the renter and guard keys 40 and 41 counterclockwise back to the position of FIG. 4 to place the lock in locked condition once again. During the unlocking operation of the keys, the tumbler levers pivoted about their selected pivots engaged against fulcrum member 100 to initially align the respective gates to plates 77 and 78 as seen in FIG. 7 and then to be returned out of alignment on locking of the lock as seen in FIG. 4.

CHANGE KEY OPERATION OF THE LOCK

In the event that it is desired to change the combination of the lock to accommodate a new renters and/or guard key, a change key 42 coded to the existing combination of the guard tumblers is inserted in place of guard key 41 in the operation to open the lock hereinbefore described. Since change key 42 does not have a stop projection 46, as does the guard key, it can be turned past the lock open position of FIG. 7 to a key changeable position of FIG. 9. As seen in FIGS. 8 and 18, change key 42 has its end projection 45 positioned within the guide slot 61 of post 60 but does not have a projection lying in slot 37 as did the guard key. As can be seen by a comparison of FIGS. 7 and 9, the further clockwise rotation of the change key moves the associated post cam 68 against cam surface 92 of the bolt plate to move the latter to a fully withdrawn position as illustrated in FIG. 9. At this point in the operation of the lock, the customer key is free to be turned further clockwise, although it will engage against cam 107 before it is turned far enough to be withdrawn through the guide notches 29 and 30 of the associated boss 27.

When the bolt plate, indicated generally at 70, has been moved fully within the lock casing through manipulation of the change key 42 as aforedescribed, the fulcrum member 100 is manually rotated to release the pivot means of the associated tumbler levers indicated generally at 110 and 120. The base portion 101 of the fulcrum member lies within a journal aperture 36 formed in the backwall 11 of the casing. A slot or hex-shaped depression 130 may be formed in the underside of base portion 101 which can be reached from the inside of the safe door mounting the lock to receive a plain or "Allen" wrench or suitable tool for manually rotating the fulcrum member 100 in a clockwise direction from that shown in FIG. 9 to that shown in FIG. 10. Such rotation of the fulcrum member releases all of the associated tumbler levers which are then free to move under the respective spring bias in a downward direction as seen in FIGS. 10 and 11 to the fully released position of FIG. 11. The renters key 40 may be turned manually to the release position of FIG. 11, or if in the position of FIG. 10 on release of the levers, may be moved to a release position due to the bias of the associated levers indicated generally at 110. It should be noted that rotation of fulcrum member 100 manually from inside the door is limited in a clockwise direction due to the abutment of cam portion 107 against stop wall 108 formed in the body 71 of the bolt plate.

Figure 12:
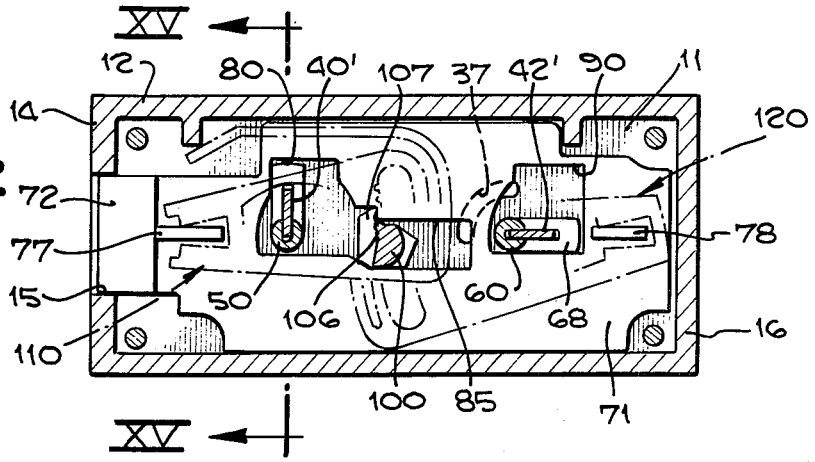
FIG. 12 is a view of the lock as in FIG. 11 showing a new customer key turned against the associated tumblers setting them in a new combination.
Figure 13:
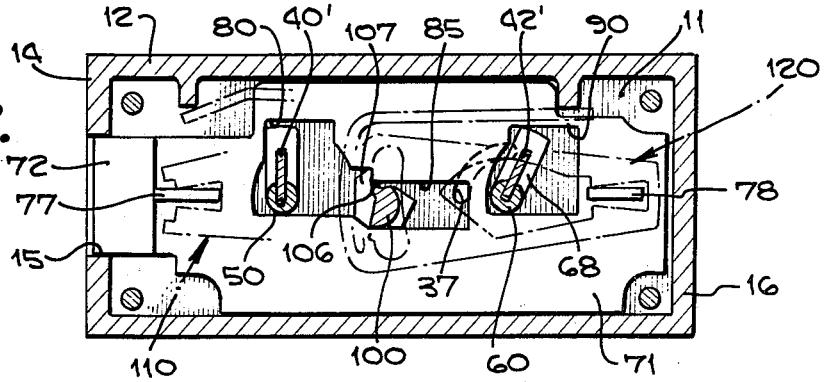
FIG. 13 is a view of the lock as in FIG. 12 showing a new guard key inserted and turned counterclockwise against the associated levers, but prior to movement of the bolt, which will initially rotate the fulcrum means back into engagement with the pivot means of the various levers.

Either or both of the renter and guard keys 40 and 41 may now be replaced. A new change key 42' may now be inserted in the lock in place of change key 42. This new change key will have a code identical to the new guard key to be used hereinafter with the lock. At the same time, a new customer key 40' may be inserted in place of key 40. To reset the lock for the new keys, the new customer key 40' is turned to an upright position, as seen in FIG. 12, automatically placing each of the associated tumbler levers, indicated generally at 110, in a new coded relationship relative to the fulcrum member 100. Thereafter, the new change key 42' may be turned counterclockwise into engagement with the guard tumbler levers, indicated generally at 120, as seen in FIG. 13 to set the guard levers in a new combination or adjustment determined by the coding of the new change key 42'. As can be seen in FIG. 13, the tumbler levers have been raised through the turning of the renter and guard keys to the generally vertical positions of FIG. 13 but have not as yet been held in the new combination position by engagement with the fulcrum member 100.

Figure 14:
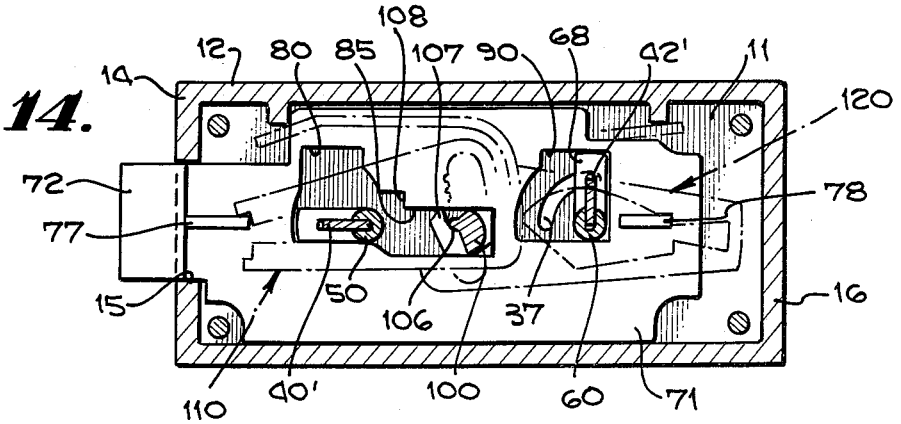
FIG. 14 is a view of the lock as in FIG. 13 showing the customer key turned to bolt locking position with the bolt moved to its locking position preparatory to turning of the guard key clockwise to a release position.
Figure 15:
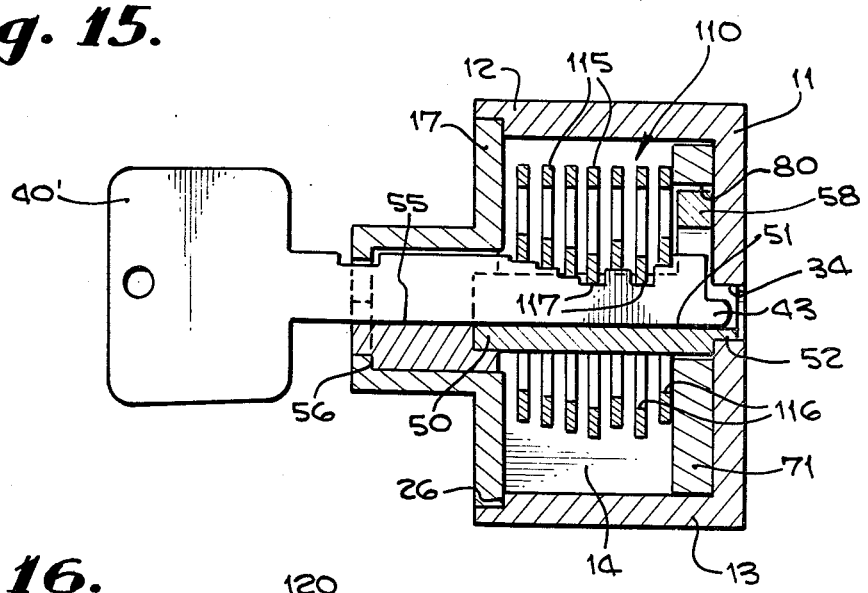
FIG. 15 is a section view of the lock taken in FIG. 12 along the plane XV—XV.

Re-engagement of fulcrum member with the pivot means of each of the renter and guard tumbler levers is automatically accomplished on turning the new change key 42' fully upright as seen in FIG. 14 and thus rotating fulcrum member 100 counterclockwise to bring rib 106 into engagement with selected ones of the pivots provided by the teeth 114 and 124 of the respective levers. As can be seen from a comparison of FIGS. 13 and 14, movement of bolt plate 70 from the position of FIG. 13 toward that of FIG. 14, to the left in FIG. 13, moves bolt plate stop surface 108 against fulcrum member cam portion 107 to pivot or rotate the fulcrum member 100 to the position of FIG. 14 and into re-engagement with the pivots of the tumbler levers. A further movement of the bolt plate to the position actually illustrated in FIG. 14 is accomplished through turning of the renter or customer key 40' to the full counterclockwise position of FIG. 14, the associated post cam 58 riding against cam surface 81 of the bolt plate to move it to the locked position illustrated. The change key can now also be turned counterclockwise to a release position. The new mating guard key may thereafter be employed for opening and closing the lock in conjunction with the new renter key 40'.

Having thus described the construction and mode of operation of a preferred exemplary embodiment of key changeable lock, and specifically a double key changeable safety deposit lock, in accordance with the present invention, it should be appreciated by those skilled in the art that various modifications, adaptations and alternations, i.e. a single key changeable lock, may be made within the scope of the present invention which is set forth in the following claims.

I claim:

1. In a changeable key lock having a bolt, a plurality of gated tumbler levers and means for operating the bolt only when the tumbler levers are placed in predeterminable positions by manipulation of a selectable key in the lock, the improvement comprising the provision of:

pivot means on one or more of said levers for providing a plurality of individually selectable pivots about which the associated lever may pivot whereby the pivotal axis of each such lever may be varied to provide for different combinations of lever movements required to open the lock; and releasable fulcrum means for engaging with said lever pivots to restrict each levers movement about a selectable one of said pivots when engaged therewith and being releasable therefrom to allow for the selection of another of said pivots to be engaged thereby, wherein:

said pivot means on each such lever comprises a rack of saw tooth-like teeth formed on an inner surface of an arcuate slot whose radius of curvature intersects the associated lever gate; and said fulcrum means comprises a fulcrum member and means for mounting said member in said arcuate slot for releasing and re-engaging said pivot means teeth.

2. In a changeable key lock having a bolt, a plurality of gated tumbler levers and means for operating the bolt only when the tumbler levers are placed in predeterminable positions by manipulation of a selectable key in the lock, the improvement comprising the provision of:

pivot means on one or more of said levers for providing a plurality of individually selectable pivots about which the associated lever may pivot whereby the pivotal axis of each such lever may be varied to provide for different combinations of lever movements required to open the lock; and releasable fulcrum means for engaging with said lever pivots to restrict each levers movement about a selectable one of said pivots when engaged therewith and being releasable therefrom to allow for the selection of another of said pivots to be engaged thereby, wherein said fulcrum means comprises a fulcrum member and means for rotatably mounting said member in said lock for releasing and re-engaging said pivot means through rotation of said member about a fixed axis.

3. The improvement in changeable key lock as in claim 2 wherein:

key activated means are provided for rotating said fulcrum member from a pivot release position to a pivot re-engagement position in response to a locking movement of the associated key.

4. The improvement in changeable key lock as in claim 3 wherein said key activated means comprises a portion of said bolt and camming means on said member for rotating said member on movement of said bolt by said key to a locking position.

5. In a changeable key lock having a bolt, a plurality of gated tumbler levers and means for operating the bolt only when the tumbler levers are placed in predeterminable positions by manipulation of a selectable key in the lock, the improvement comprising the provision of:

pivot means on one or more of said levers for providing a plurality of individually selectable pivots about which the associated lever may pivot whereby the pivotal axis of each such lever may be varied to provide for different combinations of lever movements required to open the lock wherein said pivot means comprises a plurality of pivots formed in an arcuate slot; and releasable fulcrum means for engaging with said lever pivots to restrict each levers movement about a selectable one of said pivots when engaged therewith and being releasable therefrom to allow for the selection of another of said pivots to be engaged thereby, wherein said fulcrum means comprises a fulcrum member extending through said slot and having a rib engaging one of said pivots and means for rotatably mounting said member in said lock for releasing and reengaging pivots of said levers on rotation of said member.

6. The improvement in changeable key lock as in claim 5 wherein:

key activated means are provided for rotating said fulcrum member from a pivot release position to a pivot re-engagement position in response to a locking movement of the associated key.

7. In a changeable key lock having a bolt, a plurality of gated tumbler levers and means for operating the bolt only when the tumbler levers are placed in predeterminable positions by manipulation of a selectable key in the lock, the improvement comprising the provision of:

pivot means on one or more of said levers for providing a plurality of individually selectable pivots about which the associated lever may pivot whereby the pivotal axis of each such lever may be varied to provide for different combinations of lever movements required to open the lock; and releasable fulcrum means for engaging with said lever pivots to restrict each levers movement about a selectable one of said pivots when engaged therewith and being releasable therefrom to allow for the selection of another of said pivots to be engaged thereby; wherein:

said bolt is provided with forward and rearward latch plates;

said gated tumbler levers are provided in a first set having gates alignable to said forward latch plate and a second set having gates alignable to said rearward latch plate whereby said levers must be operated by two changeable keys concurrently to open said lock; and said fulcrum means includes a fulcrum member and means for mounting said member for releasing and re-engaging lever pivots of both of said sets of levers on operation of said fulcrum means.

8. The improvement in changeable key lock as in claim 7 wherein:

said levers and said pivot means of said first and second set of levers are provided to allow for an alignment of selected pivots of different ones of said levers in a linear array to be engaged by said fulcrum means.

9. The improvement in changeable key lock as in claim 8 wherein said pivot means comprise:

a rack of saw tooth-like teeth formed on an inner surface of an arcuate slot whose radius of curvature intersects the associated lever gate.

10. In a changeable key lock having a bolt, a plurality of gated tumbler levers and means for operating the bolt only when the tumbler levers are placed in predeterminable positions by manipulation of a selectable key in the lock, said bolt being provided with forward and rearward latch plates; the improvement comprising the provision of:

pivot means on one or more of said levers for providing a plurality of individually selectable pivots about which the associated lever may pivot whereby the pivotal axis of each such lever may be varied to provide for different combinations of lever movements required to open the lock; and releasable fulcrum means for engaging with said lever pivots to restrict each levers movement about a selectable one of said pivots when engaged therewith and being releasable therefrom to allow for the selection of another of said pivots to be engaged thereby, wherein:

said gated tumbler levers are provided in a first set having gates alignable to said forward latch plate and a second set having gates alignable to said rearward latch plate whereby said levers must be operated by two changeable keys concurrently to open said lock;

said levers and said pivot means for said first and second set of levers are provided to allow for an alignment of selected pivots of different ones of said levers in a linear array to be engaged by said fulcrum means; and said pivot means comprise a fulcrum member and means for rotatably mounting said member in said lock for releasing and re-engaging said pivot means through rotation of said member about a fixed axis.

11. The improvement in changeable key lock as in claim 10 wherein:

key activated means are provided for rotating said fulcrum member from a pivot release position to a pivot re-engagement position in response to a locking movement of the associated key.

12. The improvement in changeable key lock as in claim 11 wherein said key activated means comprises a portion of said bolt and camming means on said member for rotating said member on movement of said bolt by said key to a locking position.

13. In a changeable key lock having a bolt, a plurality of gated tumbler levers and means for operating the bolt only when the tumbler levers are placed in predeterminable positions by manipulation of a selectable key in the lock, said bolt being provided with forward and rearward latch plates; the improvement comprising the provision of:

pivot means on one or more of said levers for providing a plurality of individually selectable pivots about which the associated lever may pivot whereby the pivotal axis of each such lever may be varied to provide for different combinations of lever movements required to open the lock; and releasable fulcrum for engaging with said lever pivots to restrict each levers movement about a selectable one of said pivots when engaged therewith and being releasable therefrom to allow for the selection of another of said pivots to be engaged thereby, wherein:

said gated tumbler levers are provided in a first set having gates alignable to said forward latch plate and a second set having gates alignable to said rearward latch plate whereby said levers must be operated by two changeable keys concurrently to open said lock;

said levers and said pivot means for said first and second set of levers are provided to allow for an alignment of selected pivots of different ones of said levers in a linear array to be engaged by said fulcrum means;

said pivot means comprises a plurality of pivots formed in an arcuate slot; and said fulcrum means comprises a fulcrum member extending through said slot and having a rib engaging one of said pivots and means for rotatably mounting said member in said lock for releasing and re-engaging pivots of said levers on rotation of said member.

14. The improvement in changeable key lock as in claim 13 wherein:

key activated means are provided for rotating said fulcrum member from a picot release position to a pivot re-engagement position in response to a locking movement of the associated key.

15. A double key changeable safety deposit lock comprising: a moveable bolt and an associated bolt plate means provided with forward and rearward latch plates and including cam surfaces to be engaged and moved between open and closed positions by turning renter and guard keys in said lock, a first plurality of gated tumbler guard key levers to be engaged by said guard key and having gates alignable to one of said plates and a second plurality of gated renter key levers to be engaged by said renter key and having gates alignable to the other one of said latch plates, said levers being moved to align their respective gates to receive the respective latch plates on said bolt plate to allow opening said lock only when both said keys are operated;

pivot means on each lever for providing a plurality of individually selectable pivots whereby the pivotal axis of each lever may be varied to provide for different combinations of lever movement required by an associated key to align the associated gates; and releasable pivot selecting means for normally engaging certain ones of said pivots, of levers of both said first and second plurality of levers and being releasable to allow movement of said levers to a different pivot position determined by an associated key and for re-engaging the thus aligned pivots to allow changing the combination thereof for either or both of said guard and renter keys.

16. A double key changeable safety deposit lock including a moveable bolt and an associated bolt plate including cam surfaces to be engaged and moved between open and closed positions by turning renter and guard keys in said lock, a plurality of gated tumbler guard key levers to be engaged by said guard key, said levers being moved to align their respective gates to receive latch members on said bolt plate to allow opening said lock by said keys, the improvement comprising the provision of:

pivot means on each lever for providing a plurality of individually selectable pivots whereby the pivotal axis of each lever may be varied to provide for different combinations of lever movement required by an associated key to align the associated gates; and releasable pivot selecting means for normally engaging certain ones of said pivots, and being releasable to allow movement of said levers to a different pivot position determined by an associated key and for re-engaging the thus aligned pivots and wherein said releasable pivot selecting means comprises a fulcrum member and means for rotatably mounting said member in said lock for releasing and re-engaging said pivot means through rotation of said member about a fixed axis.

17. The improvement in changeable key lock as in claim 16 wherein:

key activated means are provided for rotating said fulcrum member from a pivot release position to a pivot re-engagement position in response to a locking movement of the associated key.

18. The improvement in changeable key lock as in claim 17 wherein said key activated means comprises a portion of said bolt and camming means on said member for rotating said member on movement of said bolt by said key to a locking position.

19. A double key changeable safety deposit lock including a moveable bolt and an associated bolt plate including cam surfaces to be engaged and moved between open and closed positions by turning renter and guard keys in said lock, a plurality of gated tumbler guard key levers to be engaged by said guard key, said levers being moved to align their respective gates to receive latch members on said bolt plate to allow opening said lock by said keys, the improvement comprising the provision of:

pivot means on each lever for providing a plurality of individually selectable pivots whereby the pivotal axis of each lever may be varied to provide for different combinations of lever movement required by an associated key to align the associated gates wherein said pivot means comprises a plurality of pivots formed in an arcuate slot; and releasable pivot selecting means for normally engaging certain ones of said pivots, and being releasable to allow movement of said levers to a different pivot position determined by an associated key and for re-engaging the thus aligned pivots, wherein said pivot selecting means further comprises a fulcrum member extending through said slot and having a rib engaging one of said pivots and means for rotatably mounting said member in said lock for releasing and re-engaging pivots of said levers on rotation of said member.

20. The improvement in changeable key lock as in claim 19 wherein:

key activated means are provided for rotating said fulcrum member from a pivot release position to a pivot re-engagement position in response to a locking movement of the associated key.

* * * * *